US007162824B1

(12) United States Patent
McCormick

(10) Patent No.: US 7,162,824 B1
(45) Date of Patent: Jan. 16, 2007

(54) MODULAR TRIGGER GROUP FOR FIREARMS AND TRIGGER GROUP INSTALLATION METHOD

(76) Inventor: Michael L. McCormick, 1715 W. FM 1626, Suite 105, Manchaca, TX (US) 78652

( * ) Notice: Subject to any disclaimer, the term of this patent is extended or adjusted under 35 U.S.C. 154(b) by 0 days.

(21) Appl. No.: 10/806,300

(22) Filed: Mar. 22, 2004

Related U.S. Application Data

(63) Continuation of application No. 10/152,557, filed on May 21, 2002, now Pat. No. 6,722,072.

(51) Int. Cl.
*F41A 11/00* (2006.01)

(52) U.S. Cl. ..... 42/75.03

(58) Field of Classification Search ..... 42/41, 42/42.02, 42.03, 69.03, 75.03, 75.01, 69.01; 89/128, 139, 155, 27.11; 124/31, 32
See application file for complete search history.

(56) References Cited

U.S. PATENT DOCUMENTS

| | | | | | |
|---|---|---|---|---|---|
| 3,323,246 | A | | 6/1967 | Loffler | 42/75 |
| 3,766,677 | A | * | 10/1973 | Waddell | 42/75.04 |
| 3,785,243 | A | * | 1/1974 | Christakos | 89/149 |
| 3,863,375 | A | | 2/1975 | Browning | 42/69 |
| 3,924,512 | A | | 12/1975 | Fagg | 89/128 |
| 4,056,038 | A | | 11/1977 | Rath | 89/128 |
| 4,151,670 | A | | 5/1979 | Rath | 42/70 |
| 4,310,981 | A | * | 1/1982 | Waddell | 42/42.01 |
| 4,463,654 | A | * | 8/1984 | Barnes et al. | 89/128 |
| 4,662,098 | A | | 5/1987 | Timari | 42/69.01 |
| 4,709,617 | A | * | 12/1987 | Anderson | 89/157 |
| 4,872,391 | A | | 10/1989 | Stoner | 89/155 |
| 4,942,802 | A | * | 7/1990 | Stoner | 89/191.01 |

(Continued)

OTHER PUBLICATIONS

Murtz, Harold A. "The Gun Digest of Exploded Gun Drawings." 2005, KP Books, pp. 620, 625, and 658. Through published in 2005, the Kimler Model 82 was developed in the early 1980's.*

(Continued)

*Primary Examiner*—Michael Carone
*Assistant Examiner*—Stewart T. Knox
(74) *Attorney, Agent, or Firm*—Russell D. Culbertson; The Culbertson Group, P.C.

(57) ABSTRACT

A module housing is adapted to be inserted into an operating position in the trigger group receiving area of a firearm. The module housing includes at least one pin receiver defined by two openings formed in the module housing, one on each lateral side of the housing. A module pin is received in the pin receiver and at least one trigger group component is mounted or supported for rotation on the module pin. The pin receiver is located on the module housing so as to align with a pin receptacle of the firearm when the module housing is in the operating position. By locating the pin receiver in the module housing so as to align with a corresponding pin receptacle of the firearm when the module housing is in the operating position, the trigger group module and the trigger group components housed in the module housing may be readily supported by the OEM pin receptacle. The trigger group module, pre-assembled with one or more trigger group components, may be inserted to the operating position and then held in place using the OEM pin receptacle.

18 Claims, 5 Drawing Sheets

U.S. PATENT DOCUMENTS

| | | | | | |
|---|---|---|---|---|---|
| 4,972,617 | A | * | 11/1990 | Major | 42/25 |
| 5,038,666 | A | * | 8/1991 | Major | 89/197 |
| 5,454,182 | A | | 10/1995 | Lewis et al. | 42/51 |
| 5,487,233 | A | | 1/1996 | Jewell | 42/69.01 |
| 5,501,134 | A | | 3/1996 | Milazzo et al. | 89/139 |
| 5,614,691 | A | | 3/1997 | Taylor | 89/128 |
| 5,659,992 | A | | 8/1997 | Mistretta | 42/23 |
| 5,680,722 | A | | 10/1997 | French et al. | 42/69.03 |
| 5,697,178 | A | | 12/1997 | Haskell | 42/70.04 |
| 5,881,485 | A | | 3/1999 | Milazzo | 89/139 |
| 6,131,324 | A | | 10/2000 | Jewell | 42/69.03 |
| 6,293,040 | B1 | | 9/2001 | Luth | 42/75.01 |
| 6,347,569 | B1 | * | 2/2002 | Butler | 89/190.01 |
| 6,487,806 | B1 | | 12/2002 | Murello et al. | 42/75.03 |

OTHER PUBLICATIONS

Owner's Manual, Instruction Book for: Models 1100, 11-87 & 11-87 Super Magnum Autoloading Shotguns, pp. 1-25, Form RD 7061, Rev. Orig. 601, United States.

Winchester Model 12-12 Gauge—Repeating Shotgun, www.urgan-armory.com/diagrams/win12.htm.

* cited by examiner

MODULAR TRIGGER GROUP FOR FIREARMS AND TRIGGER GROUP INSTALLATION METHOD

CROSS-REFERENCE TO RELATED APPLICATION

This application is a continuation of U.S. application Ser. No. 10/152,557, filed May 21, 2002, now U.S. Pat. No. 6,722,072 and entitled "Trigger Group Module for Firearms and Method for Installing a Trigger Group in a Firearm." The Applicant hereby claims the benefit of this prior application under 35 U.S.C. §120. The entire content of this prior application is incorporated herein by this reference.

TECHNICAL FIELD OF THE INVENTION

The invention relates to firing mechanisms for firearms. More particularly, the invention relates to a trigger group module pre-assembled with one or more trigger group components and adapted to be received in the frame of the firearm. The invention also relates to a method of installing trigger group components in a firearm.

BACKGROUND OF THE INVENTION

Firearm firing mechanisms generally include a number of components that cooperate to hold a spring-loaded hammer in a cocked position and then selectively release the hammer. The firearm is fired or discharged when the force of the released hammer is applied, directly or through an intermediate device, to an ammunition cartridge loaded in the firearm. The components for holding the hammer in a cocked position and then releasing the hammer as desired may be referred to as a trigger group. In addition to the hammer itself, a trigger group generally includes a trigger component having a finger lever or trigger that a user pulls to release the hammer, and further includes a sear which may be a separate component or integrally formed with the trigger component. Some trigger groups also include other components such as a disconnector for example. The disconnector is used in semi-automatic firearms to catch the hammer as it rebounds after firing and to hold the hammer in a cocked position until the shooter can release the trigger and thereby reset the trigger group to the "ready to fire position." The disconnector is required for this function because semi-automatic firearms usually cycle so quickly that it is physically impossible for the shooter to release the trigger quickly enough after a discharge to allow the sear to recapture the hammer in the cocked position.

Both the hammer component and trigger component are commonly mounted for rotation in the firearm. The hammer is mounted on a hammer pin to facilitate the desired rotation, while the trigger component is mounted on a trigger pin. Each pin is retained in a respective pin receptacle formed in the firearm. Each such pin receptacle is defined by a first opening on one side of the firearm and a second opening on the opposite side of the firearm. A hammer spring is included in the trigger group to, among other things, bias the hammer forward to a striking position. The trigger component is also spring biased to provide resistance against pulling the trigger and to return the trigger after it has been pulled.

It may be desirable to modify or replace trigger group components in a firearm. This is particularly true for firearms used in competition. Such competition firearms may be fitted with special trigger group components designed to improve firearm performance or operational characteristics, or to suit the preferences of the particular user. Also, different competitions or firearm applications may require different trigger group characteristics. However, due to the relatively small components in the trigger group, the spring loading of components, the close tolerances between components, and the small area in the firearm allotted for trigger group components, a trigger group may commonly be installed only by a skilled gunsmith using specialized tools in order to ensure safe, proper, and reliable trigger group functioning. Due to the difficulty in changing out trigger group components, it is common for many competition shooters to have several different complete firearms each with a different trigger group setup for a particular competition or portion of a competition. Maintaining several complete firearms greatly increases the cost of competitive shooting.

Some prior art original equipment manufacturer (OEM) firearm designs include a detachable housing that houses trigger group components. The housing may be attached to the firearm frame with screws or with pins that extend transversely through the housing and are supported at either end by receptacles or bearing openings in the firearm frame. These prior art OEM trigger group housings attach from the bottom of the firearm and include a trigger guard and surfaces that actually form part of the exterior of the fully assembled firearm. Prior art OEM trigger group housings also house safety components that cooperate with the trigger group components. These structures and surfaces associated with the prior art OEM trigger group housings limit their use to firearms specifically designed for such housings.

SUMMARY OF THE INVENTION

The present invention provides a trigger group module that is pre-assembled with the trigger group components and adapted to be mounted in a trigger group receiving area in place of the OEM trigger group. The invention includes a special module housing and also includes the special housing pre-assembled with one or more trigger group components to form the self-contained trigger group module. The invention further includes methods for mounting or installing a trigger group in a firearm.

A module housing according to the invention is adapted to be inserted into an operating position in the trigger group receiving area of a firearm. The module housing includes at least one pin receiver defined by two openings formed in the module housing, one on each lateral side of the housing. In one form of the invention a module pin is received in the pin receiver and at least one trigger group component is mounted or supported for rotation on the module pin. In this form of the invention, the module pin includes a pin receiving opening there through and is located on the module housing so that this pin receiving opening aligns with a pin receptacle of the firearm when the module housing is in the operating position. That is, the two openings defining the pin receiver on the module housing and the pin receiving opening through the module pin are adapted to align with the openings on the firearm that define a pin receptacle for the firearm.

By locating the pin receiver in the module housing so as to align with a corresponding pin receptacle of the firearm when the module housing is in the operating position and by providing a pin receiving opening in the module pin, the trigger group module and the trigger group components housed in the module housing may be readily supported by the OEM pin receptacle. The trigger group module, pre-assembled with one or more trigger group components, may be inserted to the operating position and then a pin may be inserted or extended through the OEM pin receptacle and aligned trigger group component and module pin to support the trigger group component in the desired functional position in the firearm. The module housing and module pin hold the trigger group component in place while the module housing is being placed in the firearm. No modification to the frame of the firearm is required and no special skill or tools are required to install the self-contained, pre-assembled trigger group module.

One preferred form of the invention is adapted to be used with a firearm that includes a hammer pin receptacle and a trigger pin receptacle. The trigger group module for this firearm includes a first pin receiver and a second pin receiver. The first pin receiver aligns with the hammer pin receptacle of the firearm when the housing is in the operating position and the second pin receiver aligns with the trigger pin receptacle when the housing is in the operating position. The first pin receiver is adapted to receive a first module pin having a pin receiving opening there through and the second pin receiver is adapted to receive a second module pin having a separate pin receiving opening there through. To install this trigger group module, the original trigger group components are removed from the firearm together with any interfering components such as safety mechanisms for example, and then the pre-assembled trigger group module is placed in the operating position in the firearm. Once in the operating position, the trigger group module may be held in place by pins inserted through the openings defining the hammer pin receptacle and trigger pin receptacle, respectively. Alternatively, caps, screws, or other elements may be inserted into the OEM pin receptacle openings to cooperate with a trigger group module or module pin to retain the trigger group module in the operating position.

In yet other forms of the invention, the module housing may include no pin receiver openings located to align with OEM pin receptacle openings when the trigger group module is in the operating position in the firearm frame. Rather, the trigger group component geometry may be completely changed from the OEM trigger group geometry. In these forms of the invention, the OEM pin receptacle openings may still be used to receive screws, pins, or other devices to secure the trigger group module in the operating position in the firearm frame.

A module housing according to the invention may also include a trigger component control feature that defines or sets either the forward most or rearward most position of the trigger component. Two different trigger component control features may be used to set both the forward most and rearward most position of the trigger component. The trigger component control feature setting the rearward most position of the trigger component provides overtravel control to minimize the amount of trigger movement possible after the hammer release point. The trigger component control feature setting the forward most position of the trigger component provides take-up control which minimizes the movement of the trigger required before reaching the hammer release point. A major advantage of the present invention is that by incorporating the overtravel and take-up features in the module housing, trigger overtravel and take-up may be modified without having to modify the frame of the firearm itself.

These and other features and advantages of the invention will be apparent from the following description of the preferred embodiments, considered along with the accompanying drawings.

DESCRIPTION OF PREFERRED EMBODIMENTS

Figure 1A:
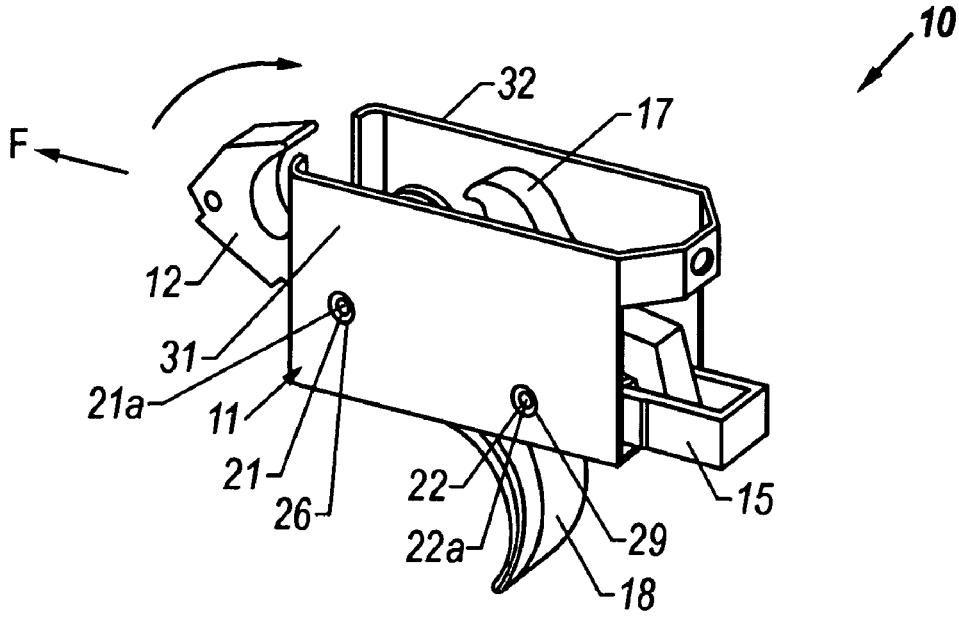
FIG. 1A is a view in perspective of a trigger group module embodying the principles of the invention.
Figure 1B:
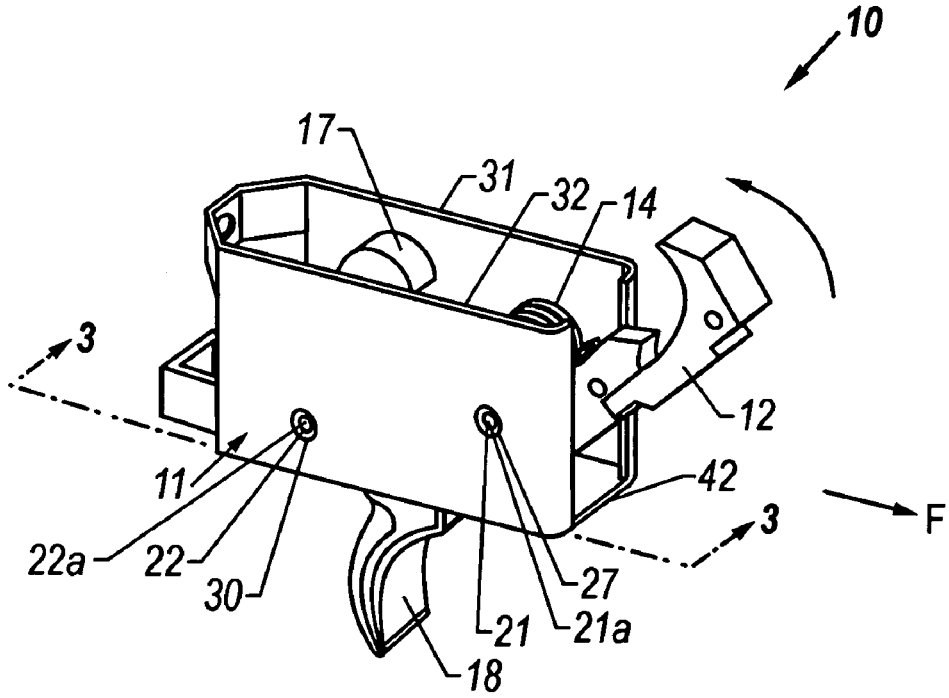
FIG. 1B is a view of the trigger group module shown in FIG. 1A from an opposite perspective to that shown in FIG. 1A.
Figure 2:
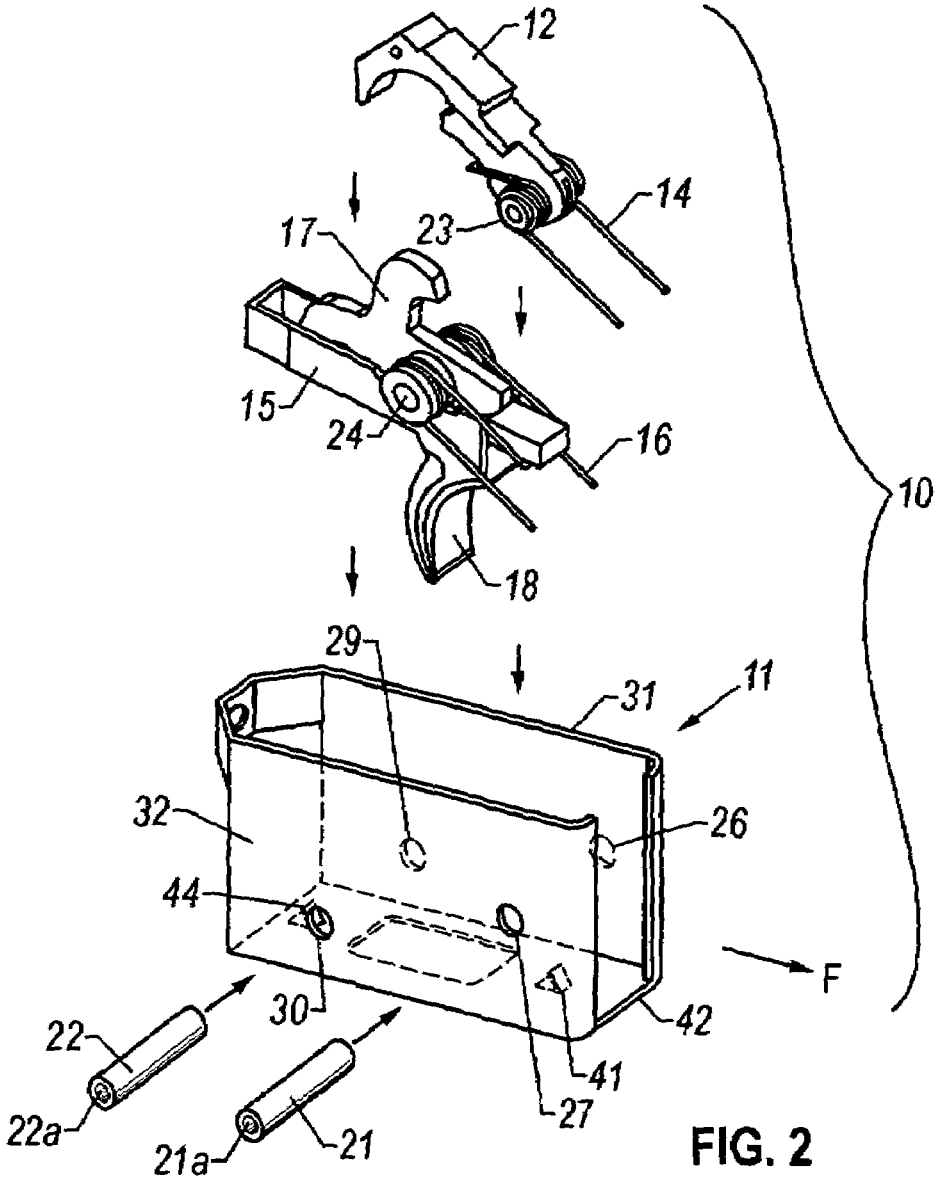
FIG. 2 is an exploded view in perspective of the trigger group module shown in FIGS. 1A and 1B.

A trigger group module 10 and module housing 11 embodying the principles of the invention may be described with reference to FIGS. 1A and 1B through FIG. 3. A method embodying the principles of the invention for installing a trigger group may be described with reference to FIGS. 4 through 8.

In the following description and claims, certain elements may be described as right side elements while others may be described as left side elements. The terms right side and left side are used only for purposes of convenience to indicate that a particular element is located on one lateral side of the respective structure while another element is located on the opposite lateral side of the structure. Of course, whether an element is truly located on a right side or left side depends upon the perspective of the viewer. For purposes of consistency, the right side elements described below will be those elements located on the right side of trigger group module 10 as viewed from the front of the module with the trigger extending downwardly, while the left side elements will be those elements on the left side as viewed from the front of the module. The direction from the rear to the front of the module will be indicated by the arrow F in each figure showing the module 10.

Referring first to FIGS. 1A and 1B through FIG. 3, trigger group module 10 includes module housing or housing 11 for containing one or more trigger group components. The trigger group components shown for purposes of example are shown best in FIGS. 2 and 3 and include a hammer 12, hammer spring 14, a trigger component 15 having a trigger or finger lever 18, a trigger spring 16, and a disconnector 17. It will be appreciated by those skilled in the art that disconnector 17 is associated with a disconnector spring, however, the disconnector spring is not necessary or helpful in describing the invention and is thus omitted from the drawings. The illustrated trigger group components are held in place in the module housing with module pins and specifically a first module pin 21 for hammer 12 and a second module pin 22 for trigger component 15. Each of the illustrated module pins 21 and 22 include an opening 21*a* and 22*a*, respectively, extending there through. First module pin 21 is received through a pin opening 23 of the hammer while second module pin 22 is received through a pin opening 24 of trigger component 15 and a pin opening (not shown) of disconnector 17.

Housing 11 includes a first pin receiver for receiving first module pin 21 and supporting the first module pin by its ends. This first pin receiver is made up of a first right side receiver opening 26 on a right lateral side or first side wall 31 of housing 11 and a first left side receiver opening 27 on the opposite lateral side or second side wall 32 of the housing. Similarly, housing 11 includes a second pin receiver for receiving second module pin 22 and supporting the second module pin by its ends. This second pin receiver is made up of a second right side receiver opening 29 and a second left side receiver opening 30. Module pins 21 and 22 may be held in place in module housing 11 by frictional engagement with the receiver openings, by "C" retainers, or by any other suitable means.

Those familiar with different types of firearms will recognize that the trigger group components shown for purposes of example in the embodiment of the invention shown in FIGS. 1A and 1B through FIG. 3 are the components used in the firing mechanism for the COLT model AR-15 rifle. However, these trigger group components are shown only for purposes of example and there are many other types and arrangements of trigger group components that may be included in a trigger group module embodying the principles of the present invention. The invention is in no way limited to the trigger group arrangement for an AR-15 rifle or the trigger group components shown in the figures. In particular, some trigger components are designed to slide along a track rather than pivot on a pin. Trigger groups having a sliding trigger component may include only a pin for the hammer.

Figure 3:
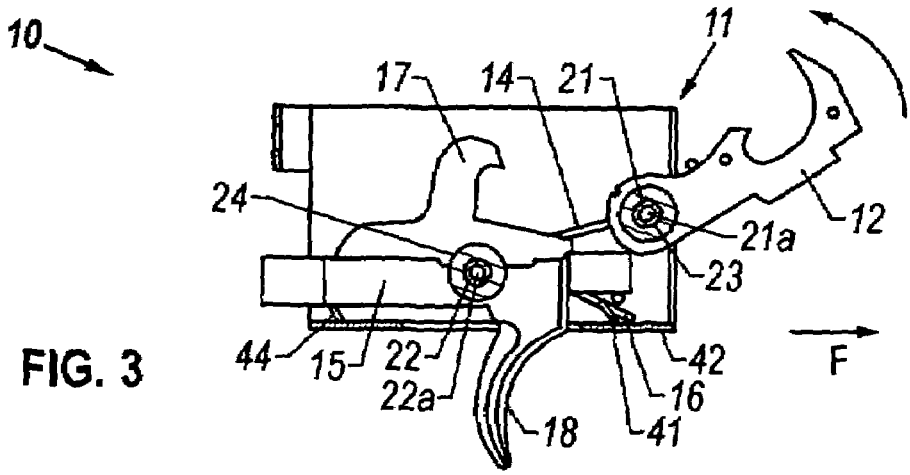
FIG. 3 is a view in section taken a long line 3—3 in FIG. 1B.

As shown best in FIG. 3, the trigger group module 10 according to the invention may include an overtravel feature 41. Overtravel feature extends from a bottom wall 42 of housing 11 in a forward or front portion of the housing in position to contact a forward part of trigger component 15 so that the component cannot rotate further forwardly or clockwise in FIG. 3. This effectively defines the rearward most position of trigger 18. As is known in the art, overtravel control prevents the trigger from excessive rearward movement after the hammer release point.

The illustrated module 10 also includes a take-up feature 44. Take-up feature 44 extends from housing bottom wall 42 in a rear portion of housing 11 in position to contact a rear part of trigger component 15. Contact between take-up feature 44 and trigger component 15 prevents the trigger component from rotating further counterclockwise in FIG. 3, and thus the take-up feature effectively defines the forward most position of trigger 18. As is known in the art, take-up control minimizes the amount of trigger movement or "take-up" before reaching the hammer release point.

Both overtravel feature 41 and take-up feature 44 represent trigger component control features that define the limits of movement of the trigger component. In the preferred embodiment of the invention where housing 11 is formed from sheet metal, both features may be formed by pressing out a portion of the bottom wall of the housing using a suitable stamp or press. The illustrated overtravel and take-up features are stamped to form an elongated member that is unsupported at one end. These elongated members may be bent upward or downward to adjust the overtravel and take-up. Set screws or other adjustable arrangements in housing 11 may also be used to form adjustable overtravel and take-up features within the scope of the present invention. It will be appreciated, however, that the invention is not limited to modules including trigger component control features of any type.

The method of installing a trigger group in a firearm may be described with reference to FIGS. 4 through 8. The method includes inserting trigger group module 10 into a trigger group receiving area of a firearm receiver or frame 50. The trigger group receiving area in the illustrated firearm frame 50 is shown generally at reference numeral 51 (distinguishable only in FIG. 6) and comprises a cavity defined between lateral side walls 53 and 54 of firearm frame 50 large enough to house all of the trigger group components and allow each of the components to move as desired to perform their respective function. As mentioned previously, the model AR-15 rifle is used as a convenient and familiar example in this disclosure. In the AR-15 example, trigger group receiving area 51 is accessible through a top opening that is exposed by removing a top component of the firearm referred to as the upper receiver (52 in FIG. 5). Firearm frame 50 comprises the portion of the model AR-15 rifle known as the lower receiver and is shown in the figures with upper receiver 52 removed to expose the top opening to trigger group receiving area 51. Upper receiver 52 may be reattached to the lower receiver or frame 50 after trigger group module 10 is installed as described in detail below.

The OEM trigger group for the AR-15 model rifle includes the hammer, trigger component, disconnector, and associated springs similar to that shown in connection with module 10. In order to support the OEM trigger group components in the trigger group receiving area 51, firearm frame 50 includes a first pin receptacle for receiving and supporting a first OEM trigger group pin and a second pin receptacle for receiving and supporting a second OEM trigger group pin. In this case the first pin receptacle comprises a hammer pin receptacle made up of a right side receptacle opening 57 and a left side receptacle opening 58. The second pin receptacle comprises a trigger component receptacle made up of a right side receptacle opening 59 and a left side receptacle opening 60. Openings 57 and 59 are formed through the right lateral side wall 53, while openings 58 and 60 are formed through the left lateral side wall 54. Each of these openings 57, 58, 59, and 60 provide bearing surfaces for supporting a respective OEM trigger group pin extending through frame 50 between left lateral side wall 53 and right lateral side wall 54. The OEM pins are not shown in the figures, however, it will be appreciated that the pins fit into the respective pair of pin openings 57 and 58 or 59 and 60, and through the pin receiving opening of the respective trigger group component or components. The OEM hammer and trigger pins for the model AR-15 rifle each include an indent in a mid-section of the pin which cooperates with a part of the trigger group serving as a detent to hold the pin in place. In the installed position, the OEM trigger group pins support the hammer, trigger component, and disconnector in their respective operational positions and allow the components to pivot as desired according to the operation of the trigger group.

It will be appreciated that the trigger group receiving area of a firearm is a relatively small area, commonly less than two inches wide. Considering the small area in which to work, the small components that fit in the area, the close tolerances between components, and the spring loading of the components, it is no easy matter to position the trigger group components in the trigger group receiving area of a firearm and hold the components in the proper position under spring pressure and aligned with the pin receptacle openings while pressing the pins in place. This trigger group installation according to the prior art method generally requires special tools, skills, and experience. The prior art trigger group installation method also requires great hand strength to hold the various components in position against the pressure of the springs in the trigger group.

Figure 4:
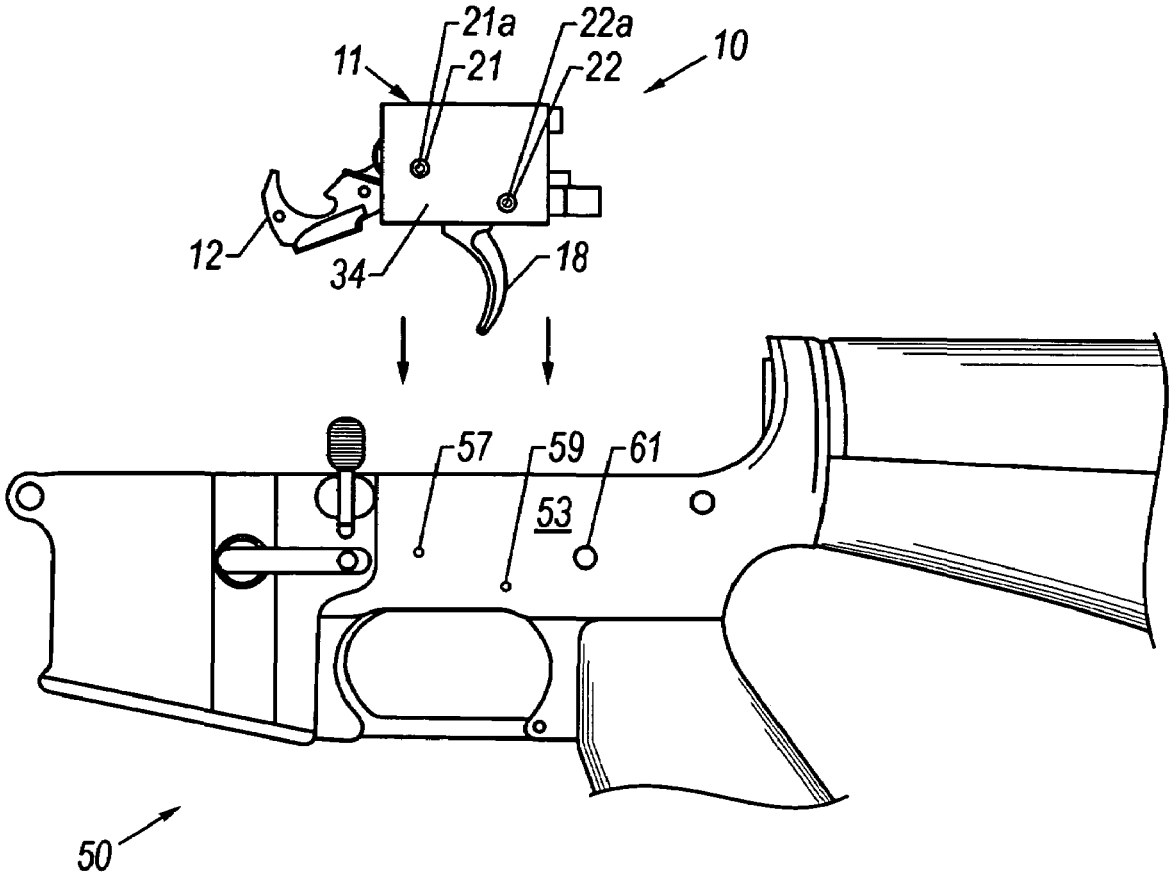
FIG. 4 is a side view showing a portion of a firearm with a trigger group module embodying the principles of the invention in position to be inserted to an operating position in the firearm.
Figure 5:
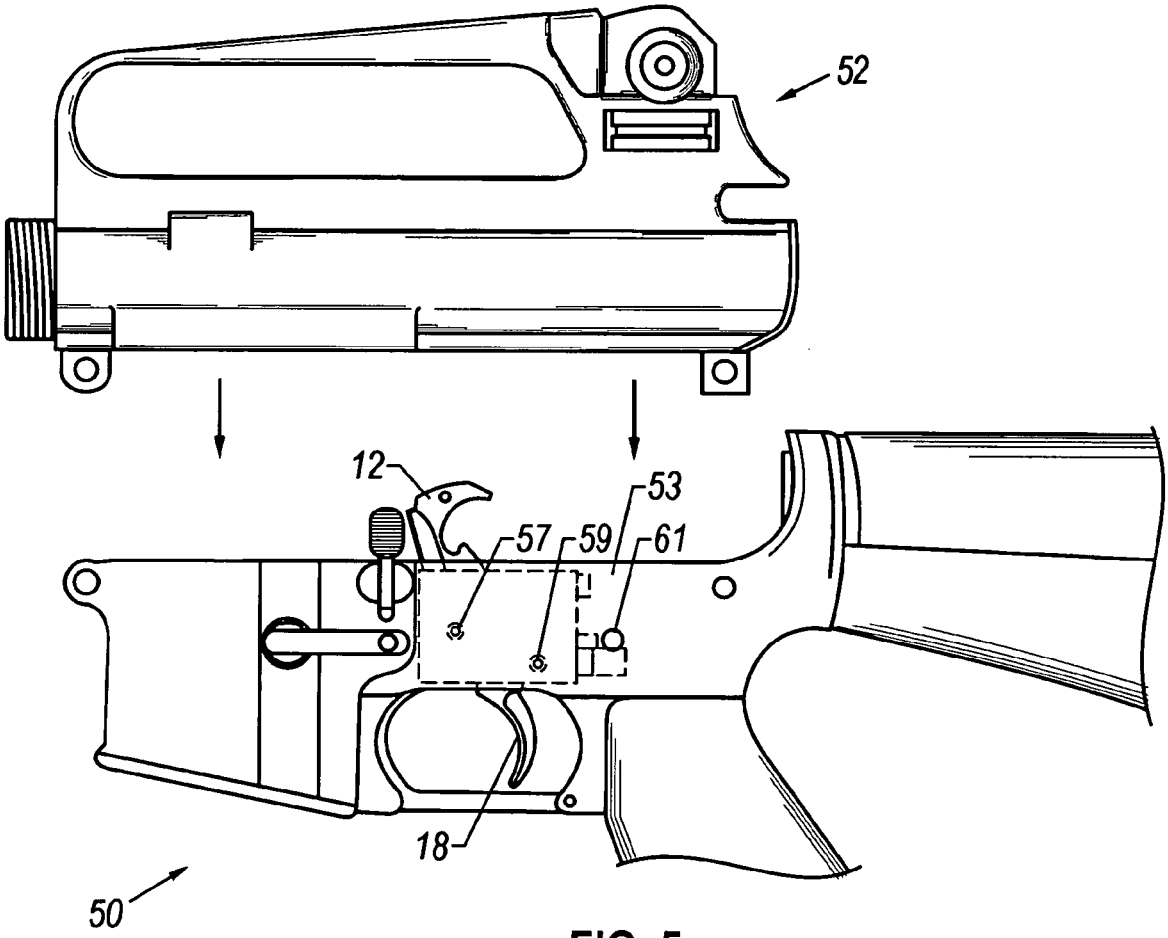
FIG. 5 is a side view similar to FIG. 4, but showing the trigger group module inserted to the operating position and showing an upper receiver in position to be connected over the trigger group module in the lower portion of the firearm.
Figure 6:
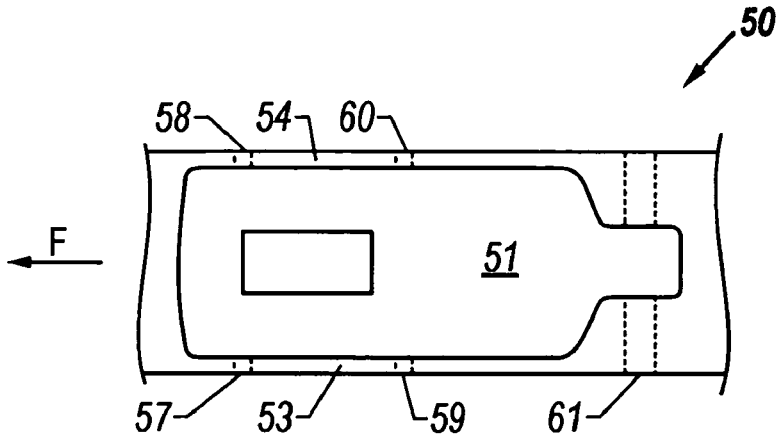
FIG. 6 is an enlarged top view of the trigger group receiving area of the firearm shown in FIGS. 4 and 5.

Trigger group installation according to the present invention using trigger group module 10 greatly simplifies installation, and may allow a new trigger group to be installed without special tools and skills. After the previous or OEM trigger group components are removed to place the firearm frame in the condition shown in FIG. 6, the present trigger group installation method includes first inserting the self-contained, pre-assembled trigger group module 10 into an operating position in firearm trigger group receiving area 51. In this operating position, at least one pin receiver on module housing 11 is aligned with a corresponding pin receptacle of the firearm. In the illustrated case, the first pin receiver is positioned with its defining openings 26 and 27 aligned with the firearm pin receptacle defined by receptacle openings 57 and 58. This alignment of openings 26 and 27 with receptacle openings 57 and 58 also aligns module pin opening 21*a* with these receptacle openings. The illustrated case also requires positioning module housing 11 with the pin receiver openings 29 and 30 aligned with firearm pin receptacle openings 59 and 60. This alignment of openings 29 and 30 with pin receptacle openings 59 and 60 also aligns module pin opening 22*a* with these pin receptacle openings. FIG. 4 shows pre-assembled trigger group module 10 positioned above the firearm and trigger group receiving area, while FIG. 5 shows the module and its housing 11 inserted to the operating position with the various openings aligned. It will be noted that inserting trigger group module 10 from the position shown in FIG. 4 to the position shown in FIG. 5 may be accomplished only after removing all of the OEM trigger group components originally in trigger group receiving area 51 and after removing the safety mechanism from its receiving opening 61, to place the firearm frame in the condition shown in FIG. 6. Removing the OEM trigger group components for a firearm such as the illustrated AR-15 rifle is accomplished by removing each OEM trigger group pin to release the respective trigger group component or components supported by the respective pin as is known in the art. It will also be appreciated especially from FIG. 5 that the safety mechanism mounted directly on the firearm frame in openings 61 is in position to cooperate with the back portion of trigger component 15 to provide the desired safety function when the trigger group module 10 is in the operating position.

When module housing 11 is in the operating position shown in FIG. 5, the lowermost part or lower extremity of the module housing is located above the lowermost edge of the receiver side walls which define trigger group receiving area 51. In particular, the lowermost part of module housing 11 is located above the lowermost edge of receiver side wall 53 and is also located above the lowermost edge of opposite receiver side wall 54 (side wall 54 being shown in the top view of FIG. 6). No portion of module housing 11 extends out of the area defined as trigger group receiving area 51. The only portion of trigger group module 10 that is exposed when the module is in the operating position is the pull portion of trigger component 15. Also, no portion of module housing 11 forms any part of the exterior surface of the assembled firearm.

Figure 7:
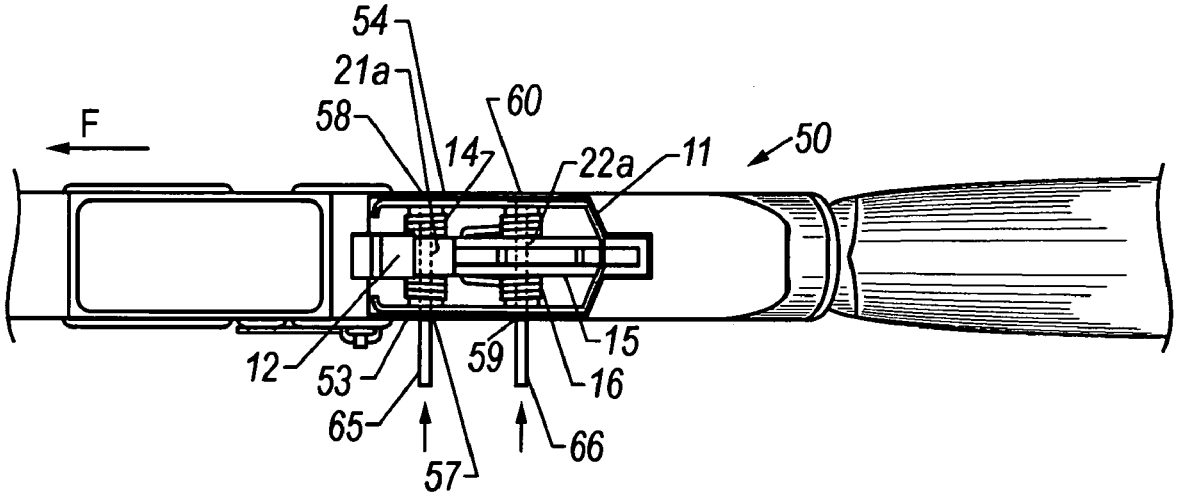
FIG. 7 is a top view of the firearm and trigger group module shown in FIG. 5, with module securing pins partially inserted.

After inserting module 10 to the operating position shown in FIG. 5 with the various pin openings aligned, the method then includes inserting a first retainer pin 65 through one of the first pin receptacle openings and through the corresponding module pin opening. FIG. 7 shows first retainer pin 65 inserted through first right side pin receptacle opening 57, through first right side receiver opening 26 of housing 11, and partially through module pin opening 21*a*.

Figure 8:
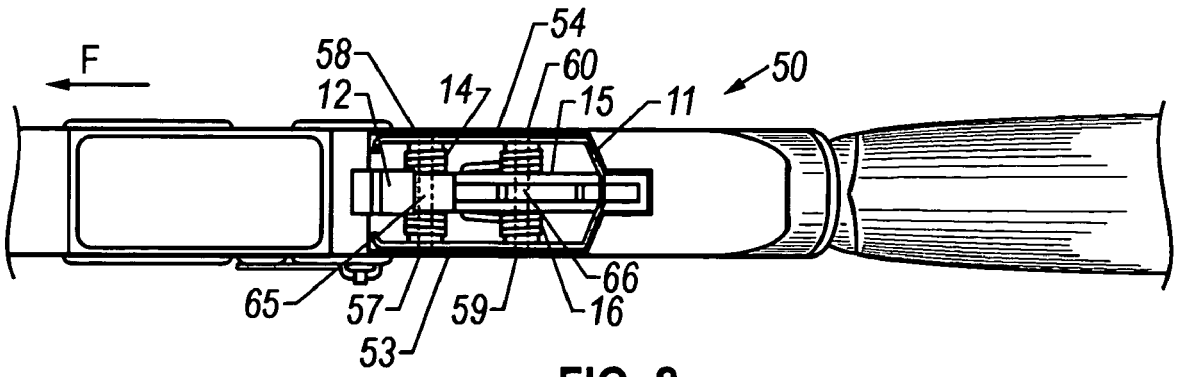
FIG. 8 is a top view similar to FIG. 7 but showing the module securing pins in the fully inserted position.

The trigger group installation method according to the invention finally includes positioning first retainer pin 65 so that the pin is supported at one end by first right side pin receptacle opening 57 and is supported at its opposite end by first left side pin receptacle opening 58 on the opposite side of firearm frame 50. This final position of retainer pin 65 is shown in FIG. 8.

In the embodiment of the invention shown in the figures, trigger group module 10 includes two module pins, first module pin 21 supporting hammer 12 and second module pin 22 supporting trigger component 15. Thus, once openings 29 and 30 making up the second pin receiver is aligned with openings 59 and 60 making up the second pin receptacle, the method includes inserting a second retainer pin 66 through one opening of the pin receptacle and into module pin opening 22*a*. FIG. 7 shows second retainer pin 66 inserted through the right side receptacle opening 59, right side receiver opening 29, and partially through module pin opening 22*a*. Second retainer pin 66 is pushed further through openings 59, 29, and 22*a* until it reaches the position shown in FIG. 8. In this position, second retainer pin 66 is supported on one end by right side pin receptacle opening 59 and is supported at its opposite end by left side pin receptacle opening 60.

In some forms of the invention, module pins 21 and 22 may not align with the OEM pin receptacles of the firearm frame. Because the module pins in the module 10 need not align with the OEM pin receptacles in some forms of the invention, those modules may include a completely different trigger group geometry and structure from the one originally designed for the firearm. Even where the module pins 21 and 22 do not align with the OEM pin receptacles the OEM pin receptacles may still be used in retaining the trigger group module 10 in the operating position in the firearm frame 50. For example, pins, screws, or other elements may be mounted in or through OEM pin receptacles and contact the module 10 or some feature on the module to serve as retaining devices or a retaining arrangement to retain the module in the desired operating position. The OEM pin receptacles may need to be modified to provide the desired function. For example, threads may be tapped into the OEM pin receptacles to accept a retainer or set screw.

It should also be noted that in the model AR-15 rifle example described above, the OEM pin receptacles are designed by the original manufacturer to support trigger group components that are not pre-assembled in a module according to the present invention. However, trigger group modules within the scope of the invention are not limited to use in firearms originally designed to be used with trigger group components assembled in place in the firearm. Rather, trigger group modules within the scope of the present invention may be used with firearms specifically designed to use the trigger group module. An OEM pin receptacle may be a receptacle designed to cooperate with a trigger group module according to the invention.

The above described preferred embodiments are intended to illustrate the principles of the invention, but not to limit the scope of the invention. Various other embodiments and modifications to these preferred embodiments may be made by those skilled in the art without departing from the scope of the following claims.

The invention claimed is:

1. A method of installing a trigger group in a firearm, the method including the steps of:

(a) assembling a number of trigger group components in a trigger group module;

(b) separating an upper receiver from the firearm to expose a trigger group receiving opening in a lower receiver of the firearm;

(c) inserting the trigger group module into the lower receiver through the trigger group receiving opening so as to place the trigger group module in an operating position in the lower receiver; and (d) after placing the trigger group module in the operating position in the lower receiver, bringing the upper receiver and lower receiver together while the trigger group module remains in the operating position and then reattaching the upper receiver to the lower receiver.

2. The method of claim 1 further including the step of retaining the trigger group module in the lower receiver with one or more retaining devices prior to reconnecting the upper receiver to the lower receiver.

3. The method of claim 2 wherein the step of retaining the trigger group module in the lower receiver includes the step of supporting the trigger group module from a pin receptacle in the lower receiver.

4. The method of claim 3 wherein the step of supporting the trigger group module from the pin receptacle in the lower receiver includes inserting a pin through the pin receptacle and through a pin receiver in the trigger group module.

5. The method of claim 3 wherein the step of supporting the trigger group module from the pin receptacle in the lower receiver includes inserting a pin through the pin receptacle and through a module pin opening included in the trigger group module.

6. A method of assembling a firearm having a frame made up of an upper receiver and a lower receiver which is separable from the upper receiver, the method including the steps of:

(a) assembling a number of trigger group components in a module housing to produce a pre-assembled trigger group module;

(b) placing the pre-assembled trigger group module in an operating position in the lower receiver; and (c) after placing the pre-assembled trigger group module in the operating position in the lower receiver, bringing the lower receiver and upper receiver together to enclose the module housing in the firearm and then securing the upper receiver to the lower receiver.

7. The method of claim 6 further including the step of securing the pre-assembled trigger group module in the operating position in the lower receiver prior to securing the upper receiver to the lower receiver.

8. The method of claim 7 wherein the step of securing the pre-assembled trigger group module in the operating position includes securing the trigger group module in the operating position through pin receptacle openings formed in opposing side walls of the lower receiver.

9. The method of claim 1 further including:

(a) prior to inserting the trigger group module into the lower receiver, removing a first OEM trigger group pin to release a first OEM trigger group component with respect to the lower receiver and with respect to a second trigger group component;

(b) prior to inserting the trigger group module into the lower receiver, removing a second OEM trigger group pin to release the second trigger group component with respect to the lower receiver;

(c) prior to inserting the trigger group module into the lower receiver, removing the first OEM trigger group component and the second trigger group component from the lower receiver; and (d) securing the trigger group module in the lower receiver through pin receptacle openings that supported either the first OEM trigger group pin or the second OEM trigger group pin.

10. The method of claim 9 wherein the step of securing the trigger group module in the lower receiver includes securing the trigger group module through pin receptacle openings that supported the first OEM trigger group pin and through pin receptacle openings that supported the second OEM trigger group pin.

11. The method of claim 9 wherein the step of securing the trigger group module in the lower receiver includes inserting a first pin through a first pin receiver of a trigger group housing included in the trigger group module.

12. The method of claim 11 wherein the step of securing the trigger group module in the lower receiver includes inserting a second pin through a second pin receiver of the trigger group housing.

13. The method of claim 6 further including:

(a) prior to placing the pre-assembled trigger group module in the operating position in the lower receiver, removing a first OEM trigger group pin to release a first OEM trigger group component with respect to the lower receiver and with respect to a second trigger group component;

(b) prior to placing the pre-assembled trigger group module in the operating position in the lower receiver, removing a second OEM trigger group pin to release the second trigger group component with respect to the lower receiver;

(c) prior to placing the pre-assembled trigger group module in the operating position in the lower receiver, removing the first OEM trigger group component and the second OEM trigger group component from the lower receiver; and (d) securing the pre-assembled trigger group module in the operating position through pin receptacle openings that supported either the first OEM trigger group pin or the second OEM trigger group pin.

14. The method of claim 13 wherein the step of securing the pre-assembled trigger group module in the operating position includes securing the pre-assembled trigger group module through pin receptacle openings that supported the first OEM trigger group pin and through pin receptacle openings that supported the second OEM trigger group pin.

15. The method of claim 13 wherein the step of securing the pre-assembled trigger group module in the operating position includes inserting a first pin through a first pin receiver of the module housing.

16. The method of claim 15 wherein the step of securing the pre-assembled trigger group module in the operating position includes inserting a second pin through a second pin receiver of the module housing.

17. A method of installing a trigger group in a firearm, the method including:

(a) separating an upper receiver from the firearm to expose a trigger group receiving opening in a lower receiver of the firearm;

(b) removing a first OEM trigger group pin to release a first OEM trigger group component with respect to the lower receiver and with respect to a second trigger group component;

(c) removing a second OEM trigger group pin to release the second trigger group component with respect to the lower receiver;

(d) after removing the released first OEM trigger group component and the released second trigger group component from the lower receiver, inserting a trigger group module into the lower receiver through the trigger group receiving opening, the trigger group module including a number of trigger group components;

(e) securing the trigger group module in an operating position in the lower receiver through pin receptacle openings in the lower receiver that supported either the first OEM trigger group pin or the second OEM trigger group pin; and (f) reconnecting the upper receiver to the lower receiver while the trigger group module remains in the operating position in the lower receiver.

18. A method of installing a trigger group in a firearm having a frame made up of an upper receiver and a lower receiver, the method including:

(a) removing a first OEM trigger group pin to release a first OEM trigger group component with respect to the lower receiver and with respect to a second trigger group component;

(b) removing a second OEM trigger group pin to release the second trigger group component with respect to the lower receiver;

(c) removing the first OEM trigger group component from the lower receiver and removing the second OEM trigger group component from the lower receiver;

(d) placing a trigger group module in an operating position in the lower receiver, the trigger group module including an assembly of trigger group components; and (e) securing the upper receiver to the lower receiver to enclose the trigger group module in the firearm.

* * * * *